US007264248B2

(12) United States Patent
Stoddart

(10) Patent No.: US 7,264,248 B2
(45) Date of Patent: Sep. 4, 2007

(54) MAGNETIC TOSS GAME

(76) Inventor: Thomas B. Stoddart, 6 Hendersons Dr., Nantucket, MA (US) 02554

( * ) Notice: Subject to any disclaimer, the term of this patent is extended or adjusted under 35 U.S.C. 154(b) by 0 days.

(21) Appl. No.: 11/338,228

(22) Filed: Jan. 24, 2006

(65) Prior Publication Data

US 2007/0170654 A1 Jul. 26, 2007

(51) Int. Cl.
*A63F 9/34* (2006.01)

(52) U.S. Cl. ..... 273/456

(58) Field of Classification Search ..... 273/456, 273/440, 239, 138.2; 446/129
See application file for complete search history.

(56) References Cited

U.S. PATENT DOCUMENTS 3,312,470 A * 4/1967 Ames ..... 473/575
3,478,466 A * 11/1969 Conner ..... 446/131
4,116,445 A * 9/1978 Forbes ..... 273/161
4,690,657 A * 9/1987 Lodrick, Sr. ..... 446/134
5,060,947 A * 10/1991 Hall ..... 273/138.2
5,085,434 A * 2/1992 Soto, II ..... 273/138.2
2004/0130095 A1* 7/2004 Miller ..... 273/239

* cited by examiner

*Primary Examiner*—Raleigh W. Chiu
(74) *Attorney, Agent, or Firm*—Davis Bujold & Daniels, P.L.L.C.

(57) ABSTRACT

A game of dexterous skill and accuracy involving a magnetically attractive pendulous game piece and an objective target which provides a magnetic field. The game is more specifically evolved from the known ring toss game so as to provide a unique challenge and numerous difficulty levels for the player to physically capture the swinging game piece in the magnetic field of the objective target.

7 Claims, 7 Drawing Sheets

MAGNETIC TOSS GAME

FIELD OF THE INVENTION

The present invention relates to a game of dexterous skill and accuracy involving a magnetically attractive pendulous game piece and an objective target which provides a magnetic field. The game is more specifically evolved from the known ring toss game so as to provide a unique challenge and numerous difficulty levels for the player to physically capture the swinging game piece in the magnetic field of the objective target.

BACKGROUND OF THE INVENTION

The known ring toss game is a game of skill reportedly invented in the $18^{th}$ Century. The game consists of a ring suspended by a string which is swung by a player toward a hook or post. If the ring is captured by the hook the swing is considered successful. This is a popular game which can still be found in various forms today though it has several drawbacks. There are no means provided to readily alter the difficulty level and there are no means provided to easily move or adjust the assembly for players of different ages and heights.

SUMMARY OF THE INVENTION

The magnet toss game is similar to a ring toss game except that the objective game piece is not a ring, but a magnetized or metal object and the target is not a hook or post, but rather a magnetic field produced by a magnet which is strong enough to capture and hold the game piece without actually coming into contact with the game piece.

An object of the invention is to secure the objective game piece to the end of a string secured to an extendable arm to a point spaced from the magnetic field generated by the target.

One object of the present invention is to provide that the length of the string between the extendable arm and the game piece may be varied to change the distance of the game piece from the target which would vary the magnetic attractive force on the game piece which, in turn, varies the difficulty of the game.

Another object of the present invention is that the magnet used to attract the game piece to the target may also be used to fasten the game to a metal surface such as a refrigerator or mounting plate supported on a non-ferrous surface so that the game is easily moved to adjust for player's heights.

Another object of the present invention is that the game is easily removed at the end of a playing session.

Still another object of the present invention is a mounting plate set at an angle in a base would allow the game to be played on a horizontal surface such as a floor or table top.

Yet another object of the present invention is that the there is no noise generated by attempts to capture the game piece by the target magnetic field and that the behavior of the game piece when it comes within close proximity of the magnetic base is entertaining and provides an interesting and educational introduction to basic principles of magnetism and magnetic fields.

DETAILED DESCRIPTION OF THE INVENTION

Figure 1:
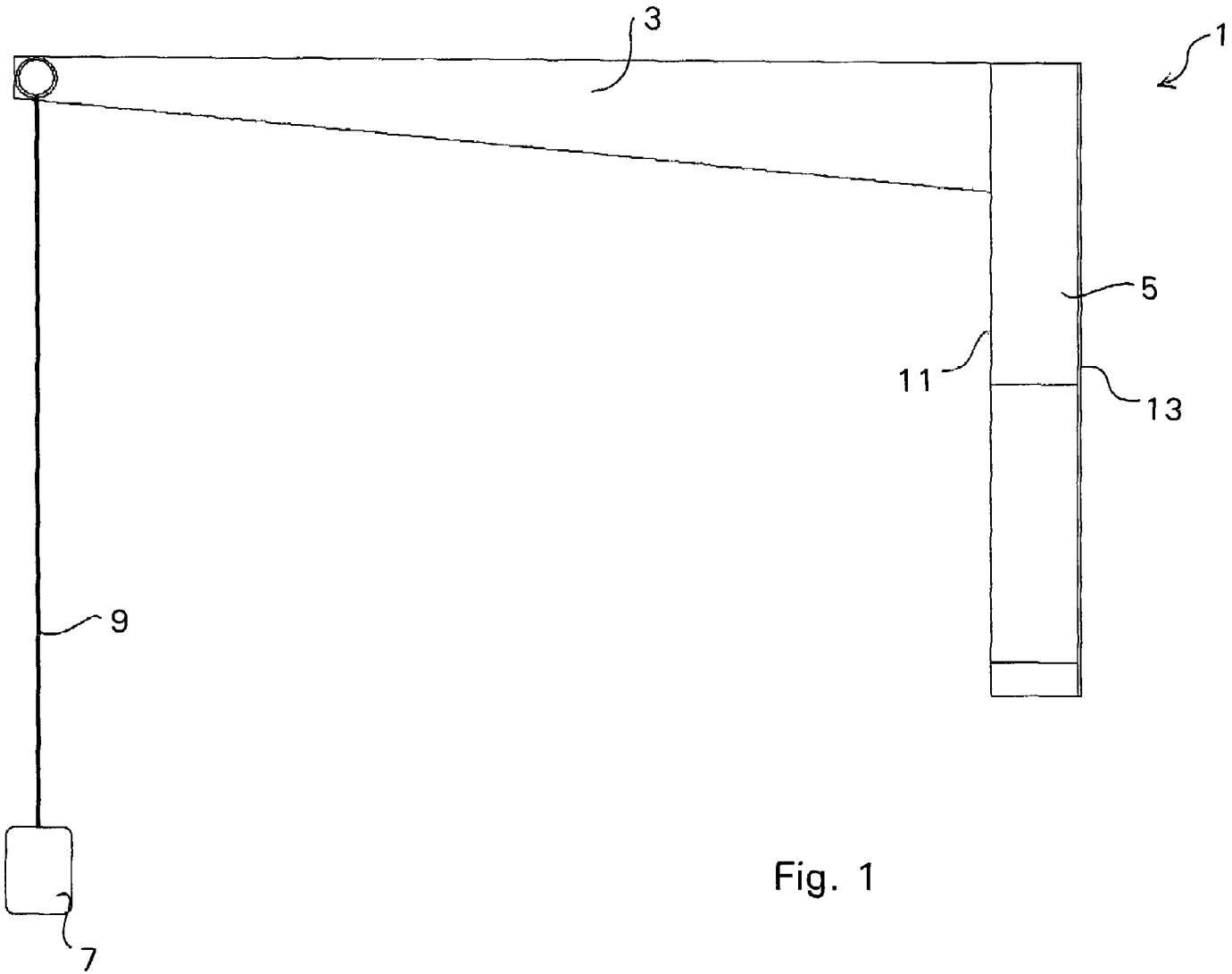
FIG. 1 is a side elevational view of one embodiment of the present invention.
Figure 2:
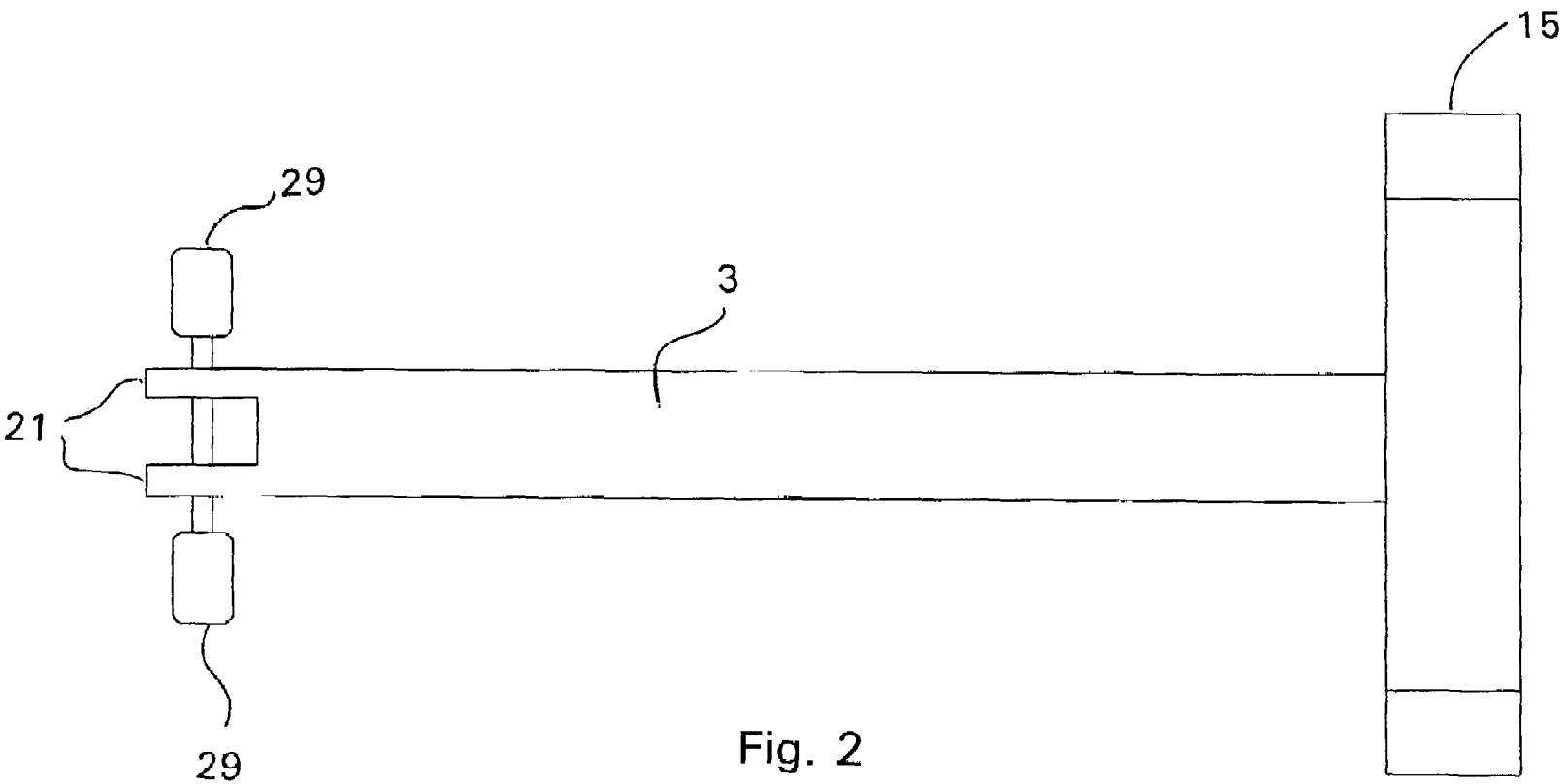
FIG. 2 is a top planar view of one embodiment of the present invention.
Figure 3:
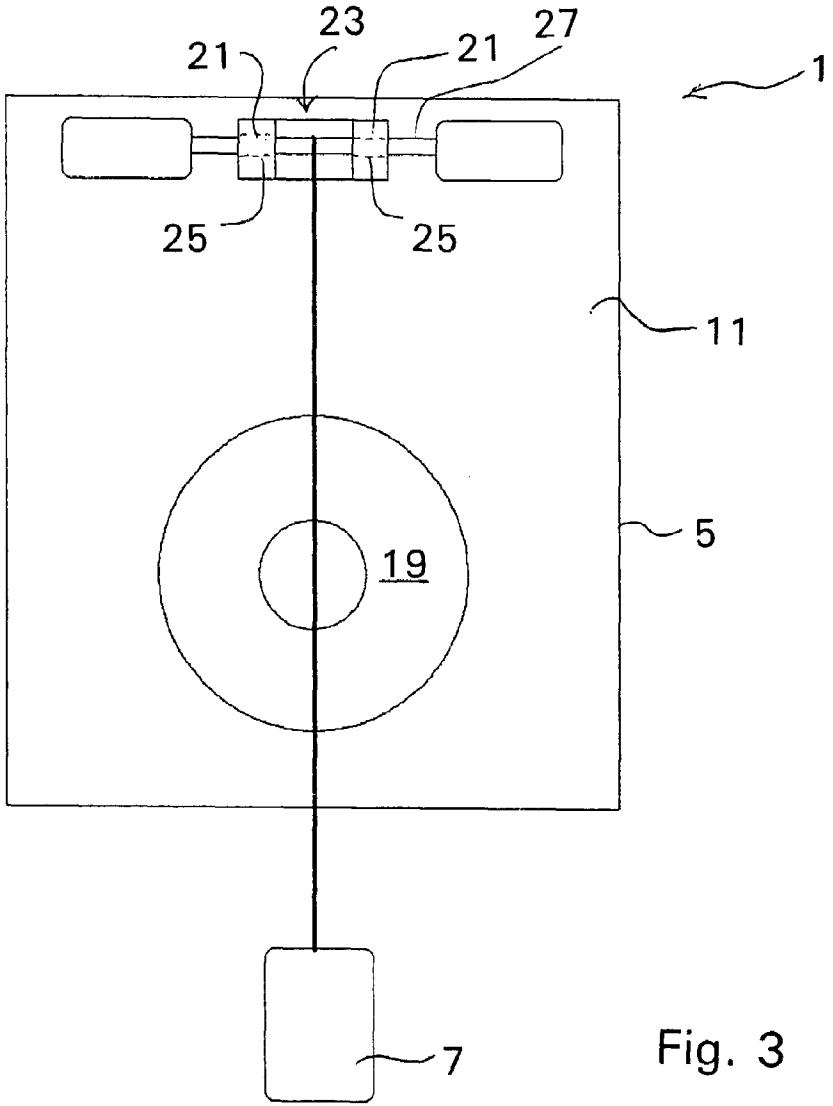
FIG. 3 is a front elevational view of one embodiment of the present invention.

As shown in FIGS. 1–3, this game utilizes an apparatus 1 generally consisting of a boom 3 fixed to a base 5 and a game piece 7 which is suspended in the manner of a pendulum by means of a string or other flexible connector from the end of the boom 3. In the embodiment shown, the base 5 is a rectangular block, although any known shape is feasible. The base 5 is defined by first and second surfaces 11, 13, a perimeter surface 15. The base 5 comprises an embedded target piece 19 which is usually a magnetically charged metal or a permanent magnet. The target piece 19 is small enough to be contained within the peripheral surface of the base 5. In a preferred embodiment, the target piece 19 is a permanent magnet in the form of a magnetic ring which extends substantially flush with both the first and second surfaces of the base 5 so as to produce a magnetic field M indicated generally as M extending outward from at least the first surface 11 of the base 5.

The second surface 13 of the base 5 provides a means for attaching the entire game to a vertical surface, such as a wall. Such means include a magnet to attach to metal surface, an adhesive to attach to non-metallic surfaces, or any other means of attachment known in the art at the time of the present invention. In a preferred embodiment, the magnetic target piece 19 extends flush to the second surface 13 of the base 5 and provides a sufficient magnetic field M to act as the means for attachment of the base 5 and boom 3 to any metallic surface as well as provide the magnetic field M to capture the game piece 7.

Extending substantially perpendicularly from the first surface 11 of the base 5 is the boom 3. A first end of the boom 3 is connected to the base 5 on a first end via glue, nails, screws or any other means known in the art. It is also conceivable to create the base 5 and boom 3 as one continuously constructed or molded piece. In a preferred embodiment, the boom 3 extends from the base 5 at a location spaced from the target piece 19. On a second free end, the boom 3 has two prongs 21 as shown in FIG. 2 created by a slot 23 formed in the free end of the boom 3. Passages 25 are formed through each of the prongs 21 which are substantially identical and aligned to define an axis A' exists through each of the pinholes.

Figure 4:
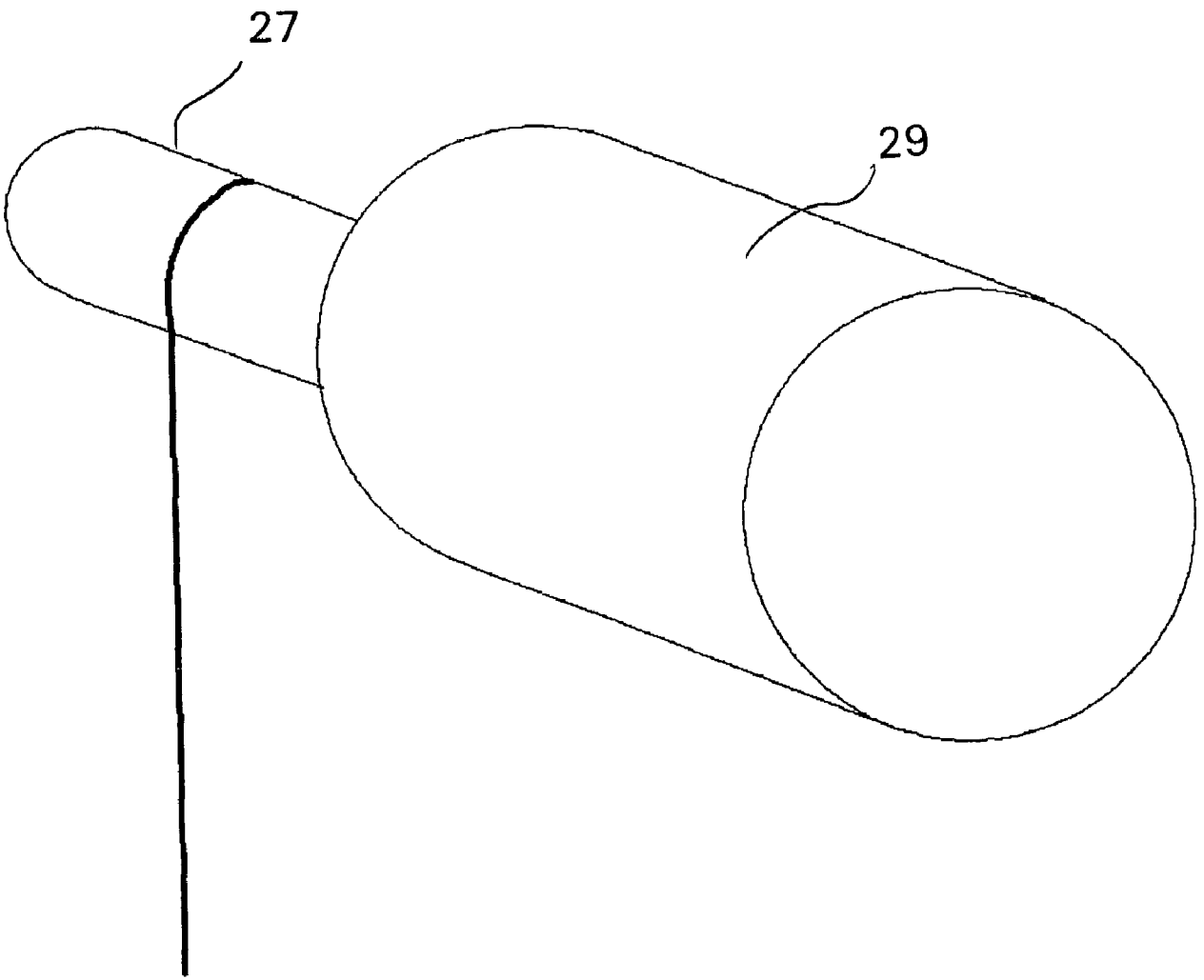
FIG. 4 is a perspective view of a peg of one embodiment of the present invention.

A peg 29, as shown in FIG. 4, is connected to a pin 27, which is positioned through the pinholes of the prongs 21. The pin 27 extends through each of the passages 25 along axis A'. In a preferred embodiment, two pegs 29 are utilized and positioned on opposing ends of the pin 27 attached to respective ends of the pin 27 such that both pegs 29 are freely rotatable with the pin 27 within the passages 25 and about the axis A'.

One end of the string is attached to an intermediate portion of the pin 27 in the slot 23 between the prongs 21.

The string is attached via any reasonable means known in the art, including a knot, staple, glue, etc. Regardless of the means, it is imperative that the string be attached such that there is no slip and it is capable of being wound and unwound about the intermediate portion of the pin 27 in a regularly controlled fashion. It is conceivable, however, that the string be attached directly to the boom 3 shaft itself. This would eliminate the need for the prongs 21, the pegs 29 or the pin 27. While this would require another means for adjusting the length of the string, it would greatly simplify the complexity of the game as well as the manufacturing costs.

On a second end of the string, the game piece 7 is attached. The game piece 7 connects to the string on its top side. The game piece 7 is made of a metal or magnetic material, either entirely or partially, such that it is capable of being attracted to the magnetic field M produced by the objective piece. It is desirable to have the game piece 7 made primarily of a plastic or wood to alleviate potential weight issues if the entire piece were made of metal. In a preferred embodiment, the body of the game piece 7 is made of wood, similar to the base 5 and boom 3 and a magnetic strip or block is attached to the game piece 7 on its bottom side.

It is also possible that the target piece 19 in the base 5 could be merely a metal element and the game piece 7 being a permanent magnet where the game piece 7 generates the magnetic field which is captured by its own attraction to the metal target piece 19. In any event it is to be appreciated that either, or both of the game piece 7 and target piece 19 could be a magnet, or even an electromagnet generating a magnetic field(s) which would attract one element to the other within a desired range during a swinging of the game piece 7. At any rate what is to be understood is that the magnetic field need only be achieved so that a magnetic attraction exists between the game piece 7 and the target piece 19.

In any event, with one end of the string fastened to the pin 27 and the other end of the string fastened to the game piece 7, the length of the string is determined such that the game piece 7 can be swung close enough to the base 5 to be captured in the magnetic field, or as discussed above, capture or retain the magnetic field of the game piece 7 by the target piece 19 piece without actually touching the base 5. In other words, the maximum length of the string should be less than the distance from pin 27 to the target piece 19.

A means for changing the effective length of the string is provided which would allow the difficulty of the game to be varied. In a preferred embodiment, the pegs 29 and the common pin 27 are capable of winding (or unwinding) the string around the pin 27 in the slot 23 of the boom 3, thus giving it an effective shorter length. Conversely, if the string is wound around the pin 27, rotating the pegs 29 in an opposing direction would give the string an effective longer length. Other means of changing the length of the string are feasible and are already known in the art.

The game is played by the player grasping the game piece 7 and swinging the game piece 7 toward the target piece 19. The toss is considered successful if the game piece 7 is captured and held by the magnetic field M of the target piece 19 in the base 5. As the game progresses, it may be desirable to make the game more difficult. Whereas it is well known that a magnetic field M decreases in strength in correlation with the distance from the magnetic source, the game provides a means for changing the length of the string, thereby affecting how closely the game piece 7 can swing near the objective piece. As the string becomes shorter, the distance between the game piece 7 and the objective piece becomes greater, thereby increasing the difficulty of the game.

Figure 5:
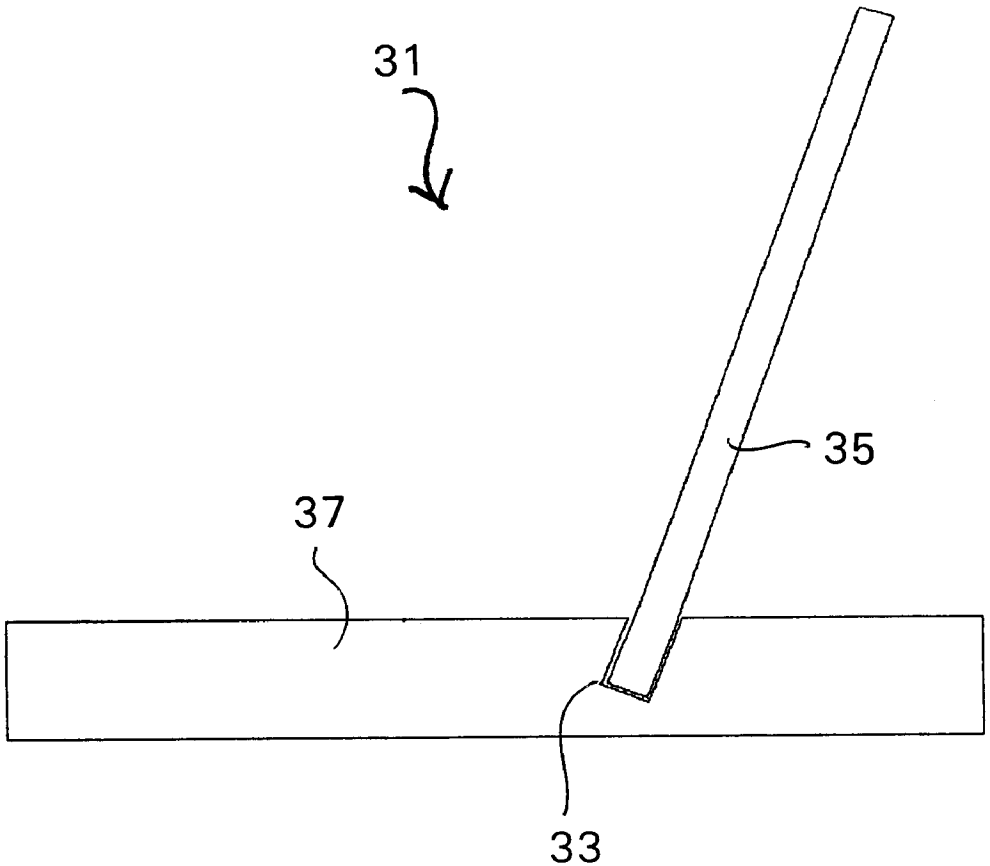
FIG. 5 is a side elevational view of a mounting device of one embodiment of the present invention.

There are several other variations of this game which will now briefly be discussed. One embodiment of the invention, shown in FIG. 5 may be provided with a mounting device 31 to allow the game to be mobile. The mounting device 31 consists of a metallic plate 35 and a support piece 37. The support piece 37 provides a flat surface which can be rested on tables, counters, etc. The top surface of the support piece 37 provides a catch 33 for inserting an edge of the metallic plate 35. The catch 33 is generally at an angle to hold the plate and hence the boom 3 at a respective angle making the game more practical on flat surfaces. It is conceivable to have a plurality of catches at varying angles to make the game more interesting. The base 5 of the game, as described above, then attaches to the metallic plate 35 of the mounting device 31, just as it would to a refrigerator, a wall or any other vertical surface. It is also to be appreciated that the base 5 may be fixed at an angle by other means known to the art to a support surface and that the base 5 and support surface may be one contiguous piece so that the game is solely played on a horizontal surface.

Figure 6:
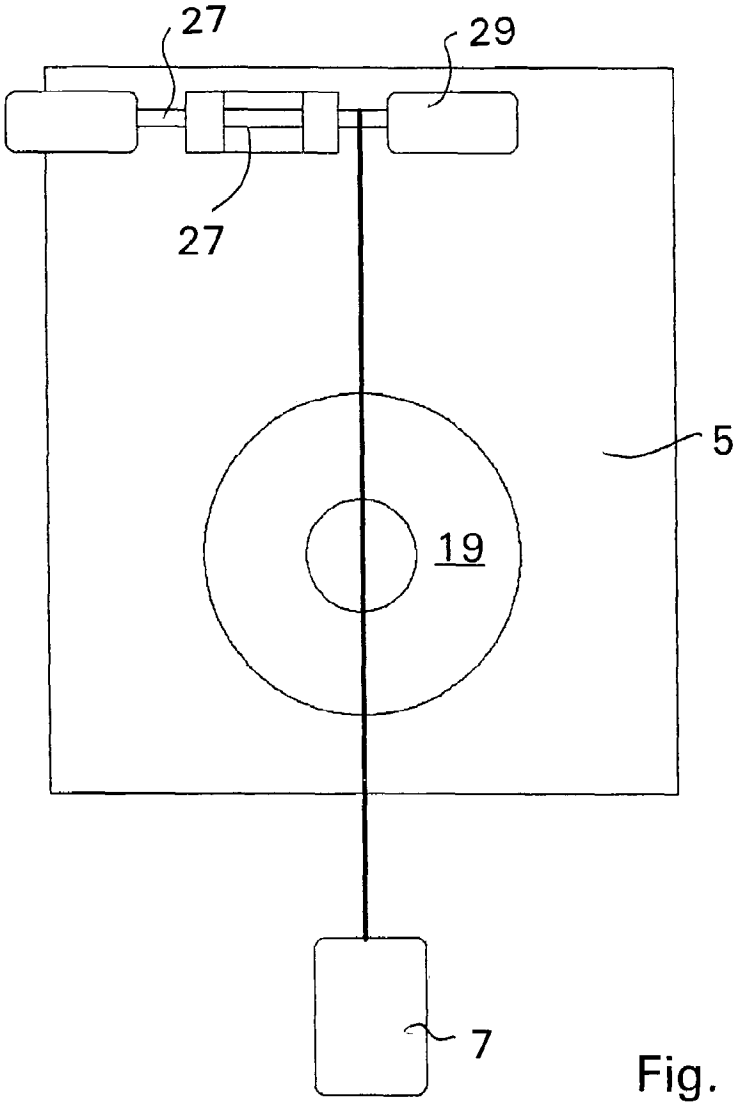
FIG. 6 is a front view of an embodiment of the present invention.

Another embodiment of the invention, shown in FIG. 6, provides the string connected to the pin 27 outside the intermediate area defined by the prongs 21. This embodiment allows the game piece 7 to swing relative to the target piece 19 without any interference from the boom 3. In this embodiment the boom 3 may or may not be offset relative to the target to make this desired result easier.

Figure 7:
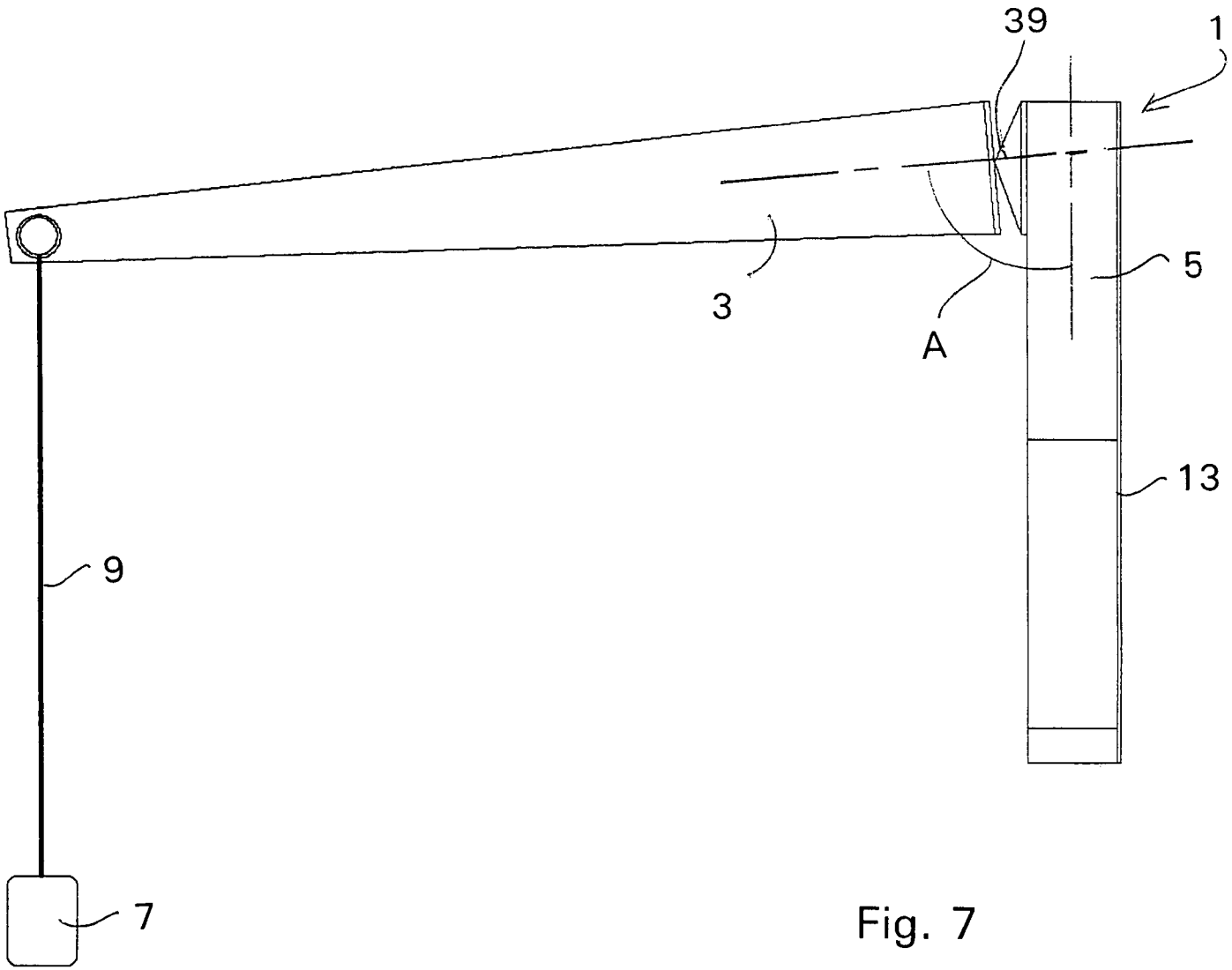
FIG. 7 is a side elevational view of one embodiment of the present invention.

In yet another embodiment of the present invention, shown in FIG. 7, the boom 3 is made variable, i.e., adjustable relative to the base 5 via a hinge 39, pivot point 39 or other means of controlling relative alignment between the boom 3 and the base 5 known in the art, to further increase the difficulty level. In this embodiment, it may be preferable to have a rigid pendulum, for instance a fixed length bar, in lieu of a string 9, although a flexible pendulum or a string 9 would also be feasible. In an embodiment with a fixed length bar, the ratio of the change in the boom angle A to the change of difficulty would then correlate to the relative position of the boom pivot to the target piece 19. This embodiment could be combined with one or more other previously described embodiments to ascertain the highest difficulty levels. For example, combining a vertically adjustable boom 3 with an adjustable string 9 length would provide a myriad of difficulty levels.

It is also highly conceivable that a plurality of targets could be utilized, and that such targets could be placed anywhere on the base and in any sort of arrangement relative to one another. Also, the targets could be of varying difficulty where the difficulty of getting the game piece to "stick", or be captured in the magnetic field of to a particular target piece could be determined by the distance of each target from the game piece. This could be accomplished in a manner for example, by a horizontal row of targets of varying distance from the game piece. The varying distance could be achieved by a different relative height of each target above the surface of the base. Difficulty could also be varied according to the particular geometry of each target, for example, a horizontal array of metal discs of various diameters equi-distant from the game piece), or alternatively the ferromagnetic properties of each target, the strength of each magnet (if magnetic targets are used), or any combination of the above. The nature of such embodiments, although very different in structure and arrangement from known games of relative skill and chance would thus be somewhat similar in playability, scoring and outcome to the known aspects of other such games of relative skill and chance where a player has a number of targets of differing difficulty and a relative score is achieved according to the difficulty of the attained target.

It is also possible to mechanically vary the magnetic field of the target piece where the target is magnetic, a piece of metal or a magnet could be moved over or near the target piece to alter the attractive force between the game piece and target. If the target is metal then a magnet could be moved near the target to alter the attractive force between the game piece and target.

In another embodiment of the game, rather than adjusting string length or boom angle, the target may be moved relative to the game piece to vary the attractive force. For example, a metal or magnetic target piece may be moved further or closer to the game piece, or alternatively the target piece may be moved to alternative positions on the base to change the difficulty.

Another possibility is to electromagnetically vary the magnetic field of the target, the game piece or both which may be electromagnets. The electric current of the electro magnets could be varied to thus change the attractive force. A combination of permanent magnets and electromagnets are possible where a permanent magnet would supply an relatively constant attractive force and a electromagnet could then be used to either null or combine with the permanent magnet to vary the force on the game piece. It is important to appreciate that the target does not necessarily have to be a permanent magnet. The use of electromagnets has the distinct advantage of being able to correlate the difficulty of the game to the voltage supplied to the electromagnet(s) which would provide a means of creating precise and repeatable levels of difficulty.

Electronic score keeping is possible by sensing changes in the magnetic field using, for instance the hall effect, etc., and electronically differentiating between successful and unsuccessful attempts to capture the game piece. If an electromagnet is used for the attractive force then score keeping electronics may be used to manipulate the difficulty level of the game by incrementally decreasing the magnetic field as each successful toss has been made. The level of difficulty may be displayed as well as the number of attempts, the number of successful attempts and which player gets a capture with the least number of tries at a particular level. A means to restart the game could be supplied as well as a choice for the number of players. Also a means of selecting difficulty levels may be supplied.

Since certain changes may be made in the above described improvement, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A game comprising:

a base having a target piece and a boom extending substantially perpendicularly from the base;

a first end of a string attached to a free end of the boom;

a game piece affixed to a second end of the string, and a means for generating a magnetic attraction between the game piece and the target piece;

a means for adjusting the length of the string is provided at the second end of the boom; and a means for attaching the base to a vertical surface.

2. The game as in claim 1, further comprising the means for adjusting the length of the string provided at the second end of the boom having a slot defining two prongs having two substantially aligned holes through each of the two prongs creating an axis; and a pin wherein the pin is inserted along the axis through the two holes and the string is attached to the pin so that no slip exists between the string and the pin as the pin rotates about the axis.

3. The game as in claim 1, further comprising a means for adjusting an attachment angle between the base and the boom.

4. A magnetic pendulum apparatus for influencing a swinging metallized or magnetic object comprising:

a pivot point about which the metallized or magnetic object swings;

a connector extending between the metallized or magnetic object and the pivot point to permit relative rotational movement of the metallized or magnetic object about the pivot point;

a target point spaced from the pivot point to which the metallized or magnetic object is attracted;

a magnetic field for retaining the metallized or magnetic object during a pendulum swing adjacent but spaced from the target point; and wherein the connector has a length defining a predetermined arc of the metallized or magnetic object passing adjacent to but spaced from the target point and the connector is a flexible string of variable length defining a plurality of predetermined arcs of the metallized or magnetic object and the pivot point is a pin supported by an arm separating the pivot point from the target point.

5. The magnetic pendulum apparatus as set forth in claim 4, wherein the arm is connected to a base supporting the target point and the magnetic field is generated by the target point and provides for the base to be secured to a metal support member to maintain the magnetic pendulum apparatus in a desired orientation.

6. The magnetic pendulum apparatus as set forth in claim 5, wherein the arm is articulatably connected to the base.

7. A game comprising:

a base having a target piece and a boom extending substantially perpendicularly from the base;

a first end of a string attached to a free end of the boom;

a game piece affixed to a second end of the string, and a means for generating a magnetic attraction between the game piece and the target piece;

a means for adjusting the length of the string is provided at the second end of the boom; and the means for generating a magnetic attraction between the game piece and the target piece also attaches the base to a vertical surface.

* * * * *